US010818463B2

(12) United States Patent
Witkoe

(10) Patent No.: US 10,818,463 B2
(45) Date of Patent: Oct. 27, 2020

(54) OVERCURRENT PROTECTION DEVICE HOLDER

(71) Applicant: Telect, Inc., Liberty Lake, WA (US)

(72) Inventor: Steven Kyle Witkoe, Liberty Lake, WA (US)

(73) Assignee: Telect, Inc., Liberty Lake, WA (US)

( * ) Notice: Subject to any disclaimer, the term of this patent is extended or adjusted under 35 U.S.C. 154(b) by 0 days.

(21) Appl. No.: 16/268,205

(22) Filed: Feb. 5, 2019

(65) Prior Publication Data

US 2020/0251298 A1 Aug. 6, 2020

(51) Int. Cl.
*H01H 85/22* (2006.01)
*H01H 85/20* (2006.01)

(52) U.S. Cl.
CPC ..... *H01H 85/22* (2013.01); *H01H 85/20* (2013.01); *H01H 85/202* (2013.01); *H01H 85/2045* (2013.01); *H01H 2085/208* (2013.01); *H01H 2085/209* (2013.01)

(58) Field of Classification Search
CPC .. H01H 85/20; H01H 85/202; H01H 85/2045; H01H 85/22; H01H 2085/208; H01H 2085/209
See application file for complete search history.

(56) References Cited

U.S. PATENT DOCUMENTS 3,824,520 A * 7/1974 Knapp, Jr. ..... H01H 85/303 337/161
D367,041 S 2/1996 Alfaro et al.
5,559,662 A 9/1996 Happ et al.
5,859,580 A 1/1999 Hashizawa et al.
D452,484 S 12/2001 Milanczak
6,359,770 B1 3/2002 Kolody et al.
6,696,969 B2 2/2004 Torrez et al.
6,771,477 B2 8/2004 Milanczak
6,784,783 B2 8/2004 Scoggin et al.
6,853,289 B2 2/2005 Scoggin
6,998,954 B2 2/2006 Milanczak
7,027,293 B2 4/2006 Yang et al.
8,625,748 B2 1/2014 Kioski et al.
8,848,346 B2 9/2014 Johnsen
2002/0114117 A1* 8/2002 Milanczak ..... H01H 85/306 361/104
2010/0259355 A1* 10/2010 Buettner ..... H01H 85/25 337/187
2013/0023150 A1* 1/2013 von zur Muehlen ..... H01H 85/202 439/532
2016/0163491 A1* 6/2016 Neyens ..... H01H 1/5833 337/195

* cited by examiner

*Primary Examiner* — Jacob R Crum
(74) *Attorney, Agent, or Firm* — Lee & Hayes, P.C.

(57) ABSTRACT

An overcurrent protection device for distributing power to a component. A cartridge may removeably receiving a TPA fuse. The cartridge may include a power input terminal and a power output terminal. When the cartridge is removeably received by a power distribution panel the power input terminal may directly couple to a power input connection of the power distribution panel and the power output terminal may directly couple to a power output connection of the power distribution panel. The directly coupled power input terminal and power output terminal being void of an intermediate busbar arranged between the cartridge and the power distribution panel.

18 Claims, 11 Drawing Sheets

OVERCURRENT PROTECTION DEVICE HOLDER

BACKGROUND

Industry-wide, the design of power distribution systems is essentially captive to proprietary overcurrent protection devices. As such, secondary power distribution system components, made by data communication manufacturers, are limited to the form factors (i.e., defined and prescribed sizes and shapes) of the proprietary overcurrent protection devices. In view of the proprietary designs, the design of any secondary power distribution system is limited to the form factors required by the various respective proprietary overcurrent protection devices, therefore increasing the cost of the secondary power distribution systems. Accordingly, there remains a desire to standardize power distribution equipment to not be captive to proprietary designs, and thus reduce cost.

SUMMARY

Overcurrent protection devices for distributing power to direct current (DC) equipment coupled to a rack are described herein. More specifically, this disclosure relates to overcurrent protection devices that have a cartridge for removeably receiving a TPA fuse which is directly couplable to a power input connection and a power output connection of a power distribution panel. This summary is provided to introduce simplified concepts of overcurrent protection devices, which are further described below in the Detailed Description. This summary is not intended to identify essential features of the claimed subject matter, nor is it intended for use in determining the scope of the claimed subject matter.

In an embodiment, an overcurrent protection device includes a cartridge for removeably receiving a TPA fuse. The cartridge may include a power input terminal and a power output terminal. When the cartridge is removeably received by a power distribution panel, the power input terminal and the power output terminal may directly couple to a power input connection and a power output connection of the power distribution panel. The directly coupled power input terminal and the directly coupled power output terminal may be void of an intermediate busbar arranged between the cartridge and the power distribution panel.

In an embodiment, an overcurrent protection device includes a cartridge. The cartridge may include a receptacle for removeably receiving a TPA fuse. The cartridge may include a power input bullet terminal connected to the receptacle and a power output bullet terminal connected to the receptacle. When the cartridge is removeably received by a power distribution panel, the power input bullet terminal may removeably couple with a power input connection of the power distribution panel and the power output bullet terminal may removeably couple with a power output connection of the distribution panel.

In another embodiment, an overcurrent protection device includes a cartridge. The cartridge may include a receptacle for removeably receiving a TPA fuse. The cartridge may include a cover arranged with the receptacle. The cover may be displaceable between an open position and a closed position. When in the closed position the cover protects the TPA fuse removeably received in the receptacle.

In another embodiment, an overcurrent protection device includes a cartridge. The cartridge may include a receptacle for removeably receiving a TPA fuse. The cartridge may include a mechanical alarm to indicate when the TPA fuse has blown from an overcurrent event. The mechanical alarm may include a member displaceable between a first position and a second position. When in the second position a portion of the member may extend a distance from the cartridge indicating the TPA fuse has blown from the overcurrent event.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This disclosure is directed to overcurrent protection devices having a cartridge for removeably receiving a TPA fuse, where the overcurrent protection device directly couples to a power input connection and a power output connection of a power distribution panel, the directly coupled overcurrent protection device being void of an intermediate busbar arranged between the cartridge and the power distribution panel. Because the overcurrent protection devices directly couple to power input and power output connections of the power distribution panel, a user may quickly and easily configure the power distribution panel as desired without being captive to proprietary designs associated with the TPA fuse. Moreover, because overcurrent protection devices directly couple to power input and power output connections of the power distribution panel without using an intermediate busbar arranged between the cartridge and the power distribution panel, a higher density of TPA overcurrent protection devices is achieved as compared to a lower density of proprietary TPA overcurrent protection devices.

In another example, an overcurrent protection device includes a cartridge for removeably receiving a TPA fuse and the cartridge may include a power input bullet terminal connected to the receptacle and a power output bullet terminal connected to the receptacle. The power input bullet terminal may removeably couple with a power input connection of the power distribution panel and the power output bullet terminal may removeably couple with a power output connection of the distribution panel. Because the power input bullet terminal and the power output bullet terminal may removably couple with the power output and power input connection of the power distribution panel, a user may quickly and easily populate the power distribution panel with TPA fuses and at a higher density. Moreover, because the power input bullet terminal and power output bullet terminal removably couple with the power output and power input connections of the power distribution panel similar to power input bullet terminals and power output bullet terminals of circuit breakers, a user may quickly and easily populate the power distribution panel with fuses and/or circuit breakers as desired.

Illustrative Overcurrent Protection Devices

Figure 1:
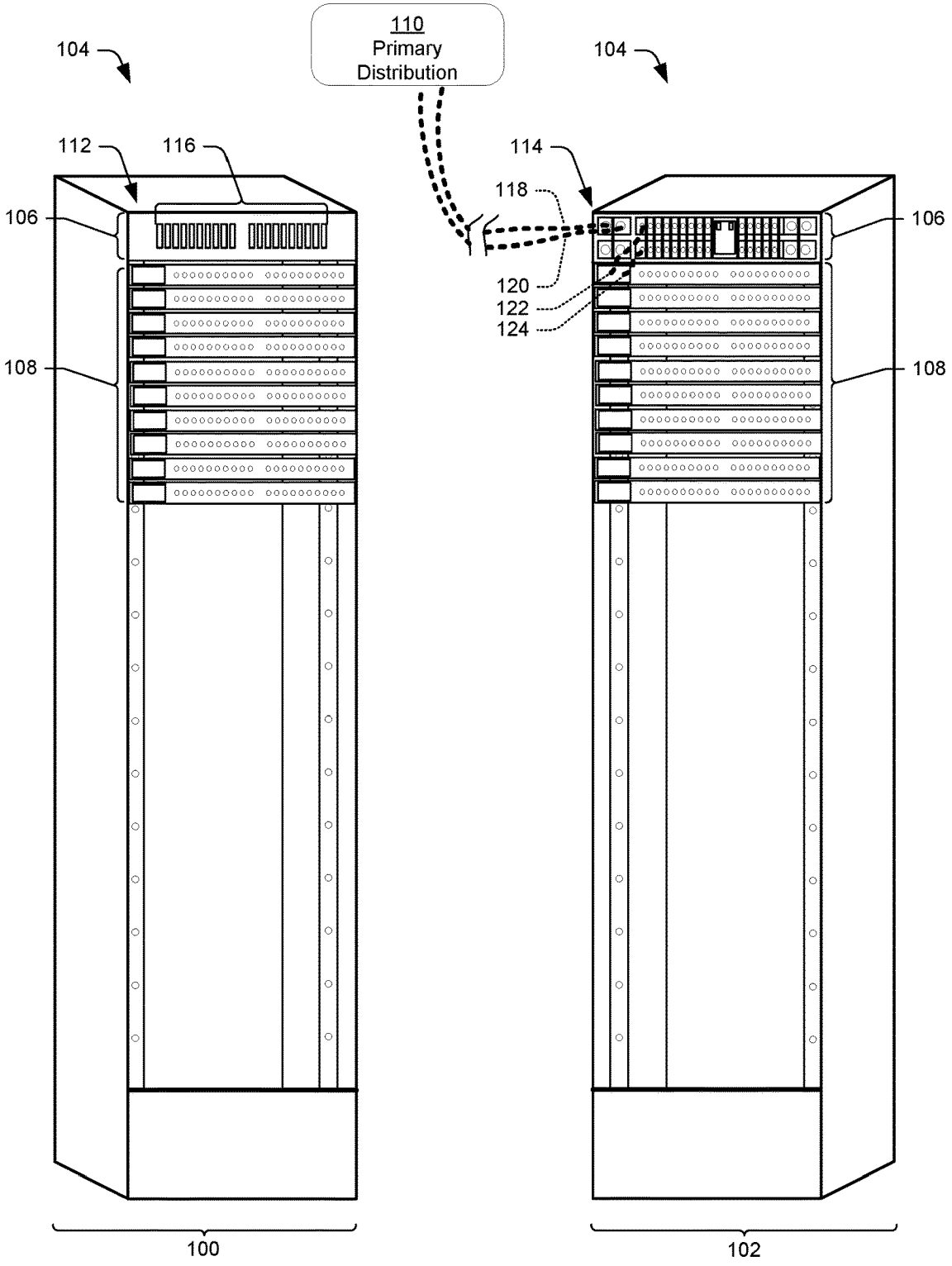
FIG. 1 illustrates a front view and a rear view of an exemplary rack populated with a power distribution panel having overcurrent protection devices removeably received by the power distribution panel according to an embodiment in this disclosure.

FIG. 1 illustrates a front view 100 and a back view 102 of an exemplary rack 104 populated with a power distribution panel 106. The rack 104 serves as a central location for connecting multiple direct current (DC) components 108. The power distribution panel 106 distributes power from a primary power distribution system 110. For example, the power distribution panel 106 may distribute power from a Battery Distribution Fuse Bay (BDFB) or Battery Distribution Circuit Breaker Bay (BDCBB). In an example embodiment, the primary power distribution system 110 may have input capacities of 8000 amps and outputs circuits up to 450 amps, and the power distribution panel 106 may be a secondary distribution system that receives power from the BDFB/BDCBB and distributes power to each component 108 in the rack 104.

In one example, components 108 may be pieces of telecommunications equipment in a telecommunication network infrastructure that may be kept or maintained in the rack 104 (e.g. cabinet) within the telecommunication network infrastructure. In another example, components 108 may be pieces of equipment in a solar power infrastructure that may be kept or maintained in the rack 104 within the solar power infrastructure. Specific examples of components 108, may include fiber optic equipment, switches, digital cross connect (DSX) systems, telecommunication panels, terminal blocks, digital radios, network office terminating equipment, cross-connect panels, modules, splitters, combiners, backplanes, repeaters, and any other telecommunication equipment or devices employed in a telecommunications infrastructure. Generally, components 108 may be those devices utilized for processing and distributing signals in infrastructure and which may be maintained in the rack 104. Components 108 may terminate, interconnect, or cross-connect a plurality of network elements within infrastructure. For example, components 108 may be utilized to distribute telecommunications signals sent to and from the infrastructure by one or more end-users using an end-user device. The interconnections between telecommunications equipment provide signal pathways for telecommunications signals (e.g., optical signals, electrical signals, digital signals, and/or analog signals). Interconnection may be via one or more components 108, such as by adapters on a module, connectors on a module, or may be internal to the components 108, such as via a printed circuit board within a component 108. With respect to the power distribution panel 106, each component 108 may be considered a load.

Front view 100 illustrates a front plate 112 of the power distribution panel 106, and back view 102 illustrates a back plate 114 of the power distribution panel 106 opposite the front plate 112 of the power distribution panel 106. The front plate 112 of the power distribution panel 106 may be disposed proximate to a first portion (e.g., a front portion) of the rack 104. The front plate 112 may be a modular face plate assembly that can be configured for low, medium, and/or high current overcurrent protection devices. For example, the front plate 112 may be configured to receive low, medium, and/or high current overcurrent protection devices.

Front view 100 illustrates the power distribution panel 106 may have a plurality of overcurrent protection devices 116 removeably received in the front plate 112 of the power distribution panel 106. The plurality of overcurrent protection devices 116 may be configured to hold GMT "grasshopper" fuses, KTK, KLM, and/or snap breakers (e.g., low current overcurrent protection devices), TPS, TPA fuses and/or circuit breakers (medium current overcurrent protection devices), TPC and/or TLS fuses (e.g., high current overcurrent protection devices), etc., suitable for telecommunications applications. The power distribution panel 106 may include any number of plurality of overcurrent protection devices 116. For example, the power distribution panel 106 may removeably receive 10 overcurrent protection devices 116. In another example, the power distribution panel 106 may removeably receive 5, 15, 20, or any quantity of overcurrent protection devices 116. In an embodiment, the quantity of plurality of overcurrent protection devices 116 may be based at least in part on how many components 108 a rack 104 is configured to house.

Back view 102 illustrates the back plate 114 of the power distribution panel 106 may be disposed proximate to a second portion (e.g., a back portion) of the rack 104. In some examples, the back plate 114 may be a modular frame assembly. The modular frame assembly may include a modular frame, one or more first modules removably attached in the modular frame, and one or more second modules, different from the one or more first modules, removably attached in the modular frame. The one or more first modules may include one or more input modules to attach the power distribution panel 106 to one or more power input cables 118 and to one or more power return cables 120. The one or more power input cables 118 and the one or more power return cables 120 are attached to the primary power distribution system 110. The one or more second modules may include one or more output modules to attach the power distribution panel 106 to one or more power output lines 122 and to one or more power return lines 124. The one or more power output lines 122 and the one or more power return lines 124 are attached to one or more of the plurality of components 108. The one or more second modules (e.g., output modules) may be electrically interconnected with the plurality of overcurrent protection devices 116 (described in detail below).

Figure 2:
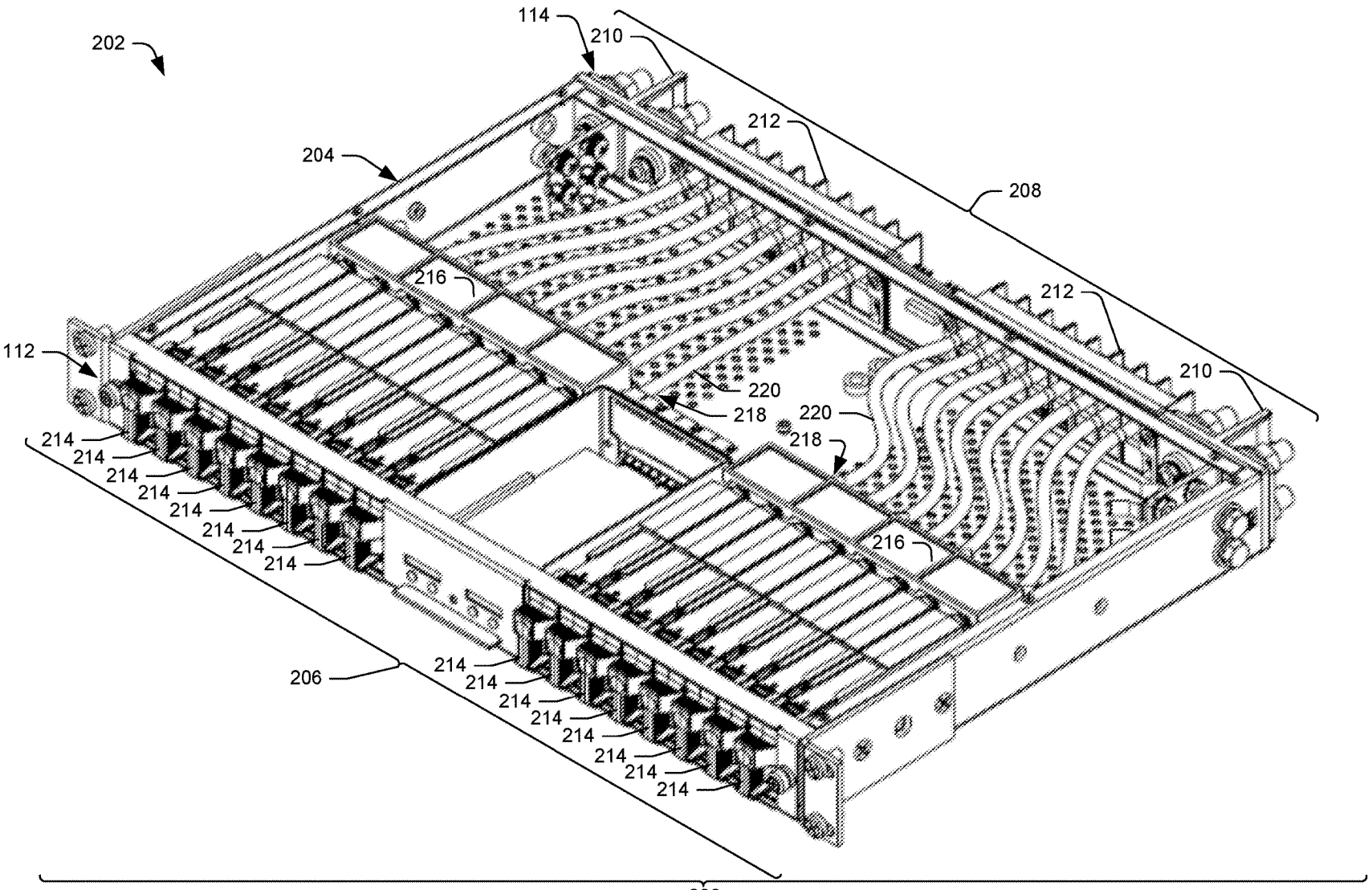
FIG. 2 illustrates a front perspective view of an example power distribution panel having overcurrent protection devices removeably received by the power distribution panel that may be implemented in the rack of FIG. 1 according to an embodiment in this disclosure.

FIG. 2 illustrates a front perspective view 200 of an example power distribution panel 202 that may be implemented in the rack 104 of FIG. 1. The power distribution panel 202 may be the same as the power distribution panel 106 discussed above. Inasmuch as FIG. 2 depicts the power distribution panel 202 implementable in the rack 104 of FIG. 1, while referring to the same elements and features of the power distribution panel 202, the following discussion of specific features may refer to FIG. 1 except where explicitly indicated. In particular, FIG. 2 illustrates an embodiment of the power distribution panel 202, including the front plate 112 and the back plate 114.

FIG. 2 illustrates the power distribution panel 202 including a chassis 204. The chassis has a front side 206 and a back side 208 opposite the front side 206. The chassis 204 may have a 1 RU (rack unit) height. The back plate 114 may include input modules 210 to attach the power distribution panel 202 to the one or more power input cables 118 and to the one or more power return cables 120, and the back plate 114 may include output modules 212 to attach the power distribution panel 202 to the one or more power output lines 122 and to the one or more power return lines 124.

In one example, the input modules 210 may include a low current input module via which the power distribution panel 202 receives about 125 amperes from the power input cables 118 and the power return cables 120 attached to the primary power distribution system 110. In another example, the input modules 210 may include medium current input modules via which the power distribution panel 202 receives about 300 amperes from the power input cables 118 and the power return cables 120 attached to the primary power distribution system 110. In another example, the input modules 210 may include high current input modules via which the power distribution panel 202 receives about 600 amperes from the power input cables 118 and the power return cables 120 attached to the primary power distribution system 110.

In one example, the output modules 212 may include low current output modules via which the power distribution panel 202 outputs about 30 amperes to the power output lines 122 and the power return lines 124 attached to the components 108. In another example, the output modules 212 may include medium current output modules via which the power distribution panel 202 outputs about 100 amperes to the power output lines 122 and the power return lines 124 attached to the components 108. In another example, the output modules 212 may include low and medium current output modules via which the power distribution panel 202 outputs about 30 amperes and 100 amperes to power output lines 122 and the power return lines 124 attached to the components 108. In another example, the output modules 212 may include high current output modules via which the power distribution panel 202 outputs about 250 amperes to power output lines 122 and the power return lines 124 attached to the components 108.

FIG. 2 illustrates the front plate 112 may receive a plurality of overcurrent protection devices 214. The plurality of overcurrent protection devices 214 may be the same as the plurality of overcurrent protection devices 116 illustrated in FIG. 1.

The plurality of overcurrent protection devices 214 may be a plurality of medium current overcurrent protection devices. For example, one or more of the plurality of overcurrent protection devices 214 may include a TPA fuse. In another example, one or more of the plurality of overcurrent protection devices 214 may include a circuit breaker. In another example, one or more of the plurality of overcurrent protection devices 214 may include a low current overcurrent protection device (e.g., GMT "grasshopper" fuse, KTK, KLM, and/or breaker). In another example, one or more of the plurality of overcurrent protection devices 214 may include a plurality of high current overcurrent protection devices (e.g., TPC and/or TLC fuse).

Each overcurrent protection device of the plurality of overcurrent protection devices 214 may have a width of about 0.745 inches, a height of about 1.495 inches, and a length of about 5.940 inches. Because each overcurrent protection device of the plurality of overcurrent protection devices 214 may have a width of about 0.745 inches, the power distribution panel 202 may have a higher density of about 0.745 inches per fuse than a lower density of about 1.197 inches per fuse of the proprietary overcurrent protection devices. For example, because of the proprietary overcurrent protection devices have an intermediate busbar arranged between a fuse cartridge and a power distribution panel, the proprietary TPA overcurrent protection devices have the lower density of about 1.197 inches per fuse than the higher density of about 0.745 inches per fuse of the power distribution panel 202. Because of the higher density of about 0.745 inches per fuse, the power distribution panel 202 may be capable of removeably receiving about sixteen (16) overcurrent protection devices 214.

FIG. 2 illustrates the power distribution panel 202 may include busbars 216. The busbars 216 may removably receive a respective end 218 of internal power lines 220. For example, the busbars 216 may include a plurality of openings arranged therein, and each end 218 of the internal power lines 220 may be removably received by a respective opening of the plurality of openings of the busbars 216. When removeably received by the power distribution panel 202, the plurality of overcurrent protection devices 214 may directly couple with the busbars 216. For example, when the plurality of overcurrent protection devices 214 are removeably received by the power distribution panel 202, each of the plurality of overcurrent protection devices 214 may directly couple to a power input connection and a power output connection of the busbar 216 (described in more detail below). Each of the internal power lines 220 may provide power to a respective overcurrent protection device 214 via the busbars 216. The directly coupled plurality of overcurrent protection devices 214 being void of intermediate busbars arranged between the plurality of overcurrent protection devices 214 and the busbars 216 of the power distribution panel 202. For example, each of the plurality of overcurrent protection devices 214 directly couple to a power input connection and power output connection of the busbars 216 without the use of an intermediate busbar arranged between the plurality of overcurrent protection devices 214 and the power input connection and power output connection of the busbars 216.

Figure 3:
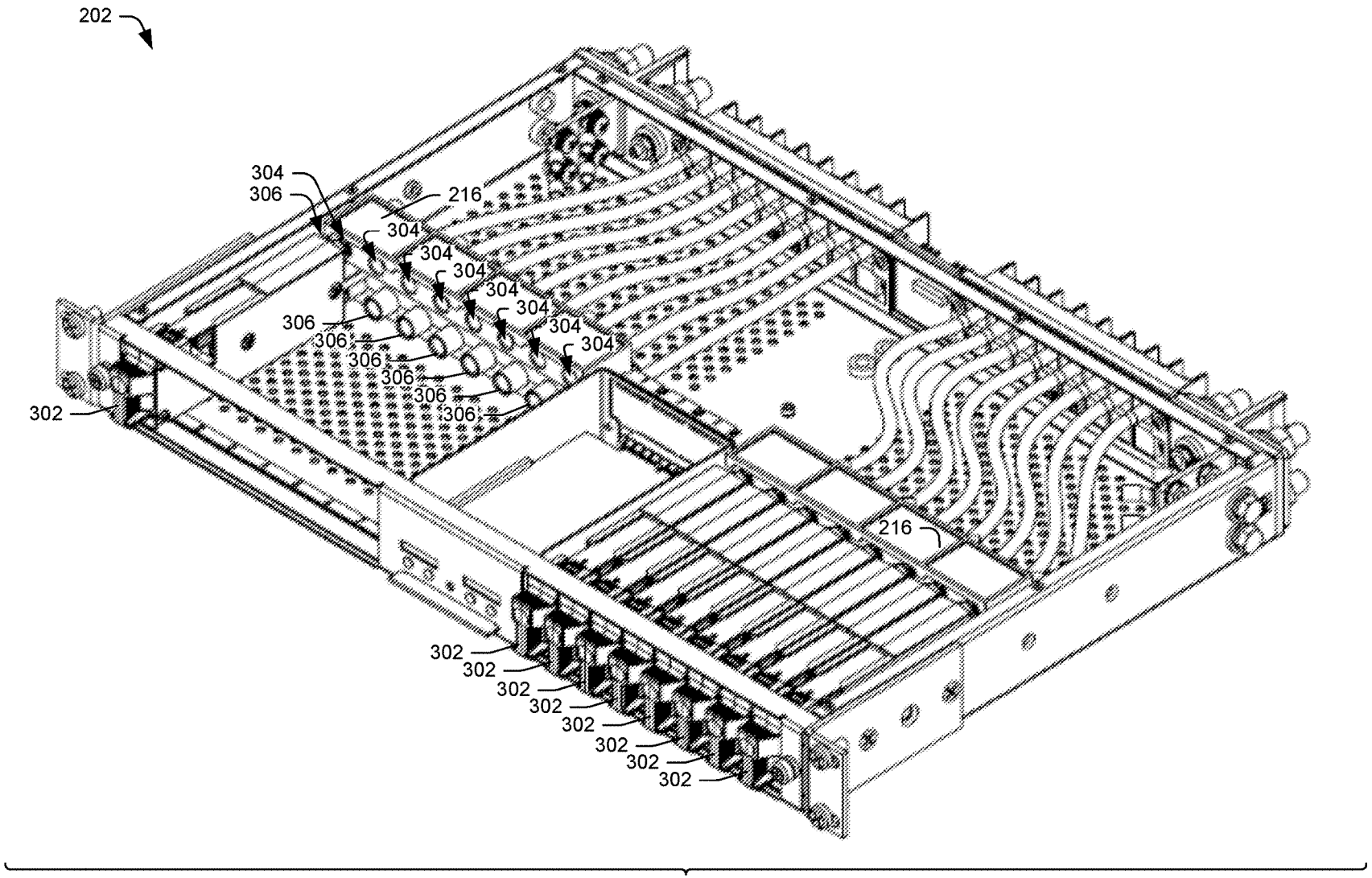
FIG. 3 illustrates a front perspective view of an overcurrent protection device directly coupled to a power input terminal and a power output terminal of the power distribution panel illustrated, in FIG. 2, according to an embodiment in this disclosure.

FIG. 3 illustrates a front perspective view 300 of overcurrent protection devices 302 directly coupled to power input connections 304 and power output connections 306 of the power distribution panel 202 illustrated, in FIG. 2, according to an embodiment in this disclosure. The overcurrent protection devices 302 may be the same as the plurality of overcurrent protection devices 214 discussed above.

The power input connections 304 and power output connections 306 may directly couple to power input terminals and power output terminals of the overcurrent protection devices 302. The power output connections 306 may be connectable ends of the internal power lines 220. For example, the power output connections 306 may be female coupling ends of the internal power lines 220 that are fixed in the busbars 216 and removeably couple with the power output terminal. The directly coupled power input terminals and power output terminals being void of an intermediate busbar arranged between the overcurrent protection devices 302 and the power input connections 304 and power output connections 306 of the busbars 216. For example, each overcurrent protection device 302 may include a pair of power input and power output terminals that may cooperatively couple with a respective pair of the power input connection 304 and the power output connection 306 of the busbars 216 without the use of an intermediate busbar arranged between the overcurrent protection devices 302 and the busbars 216.

A user may quickly and easily removeably receive any one of the overcurrent protection devices 302 with the power distribution panel 202. For example, a user may quickly and easily slideably displace any one of the overcurrent protection devices 302 into the power distribution panel 202, and the user may quickly and easily slideably displace any one of the overcurrent protection devices 302 out of the power distribution panel 202. When the user slideably displaces one of the overcurrent protection devices 302 into the power distribution panel 202, the pair of power input and power output terminals of the overcurrent protection device 302 may slideably couple with a respective pair of the power input connection 304 and the power output connection 306 of the busbars 216. When the user slideably displaces one of the overcurrent protection devices 302 out of the power distribution panel 202, the pair of power input and power output terminals of the overcurrent protection device 302 may slideably decouple with a respective pair of the power input connection 304 and the power output connection 306 of the busbars 216. The overcurrent protection devices 302 may slideably displace linearly into and/or out of the power distribution panel 202 to cooperatively couple with a respective pair of the power input connection 304 and the power output connection 306 of the busbars 216.

Figure 4:
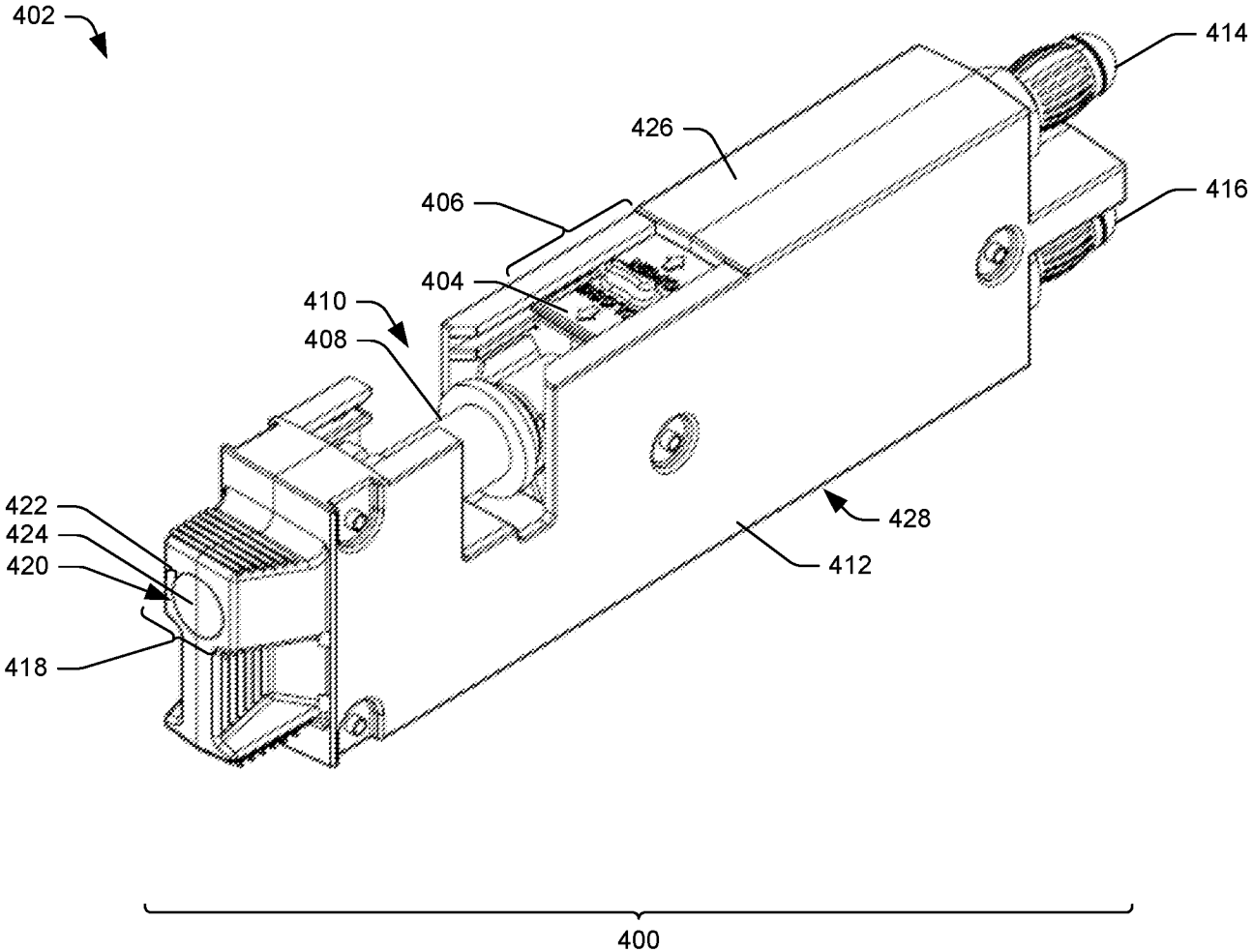
FIG. 4 illustrates a front perspective view of an example overcurrent protection device including a cover in an open position and a TPA fuse removeably received in a receptacle according to an embodiment in this disclosure.

FIG. 4 illustrates a front perspective view 400 of an example overcurrent protection device 402 including a cover 404 in an open position 406 and a TPA fuse 408 removeably received in a receptacle 410 according to an embodiment in this disclosure. The example overcurrent protection device 402 may be the same as the overcurrent protection device 302 discussed above.

The overcurrent protection device 402 may include a cartridge 412. The cartridge 412 may include a power input terminal 414 and a power output terminal 416. When the cartridge 412 is removeably received by the power distribution panel 202, the power input terminal 414 may directly couple to the power input connection 304 of the power distribution panel 202. The directly coupled power input terminal 414 being void of an intermediate busbar arranged between the cartridge 412 and the power distribution panel 202. When the cartridge 412 is removeably received by the power distribution panel 202, the power output terminal 416 may directly couple to the power output connection 306 of the power distribution panel 202. The directly coupled power output terminal 416 being void of an intermediate busbar arranged between the cartridge 412 and the power distribution panel 202. The power input terminal 414 may include a bullet type power input terminal and the power output terminal may include a bullet type power output terminal.

The cartridge 412 may include a mechanical alarm 418 to indicate when the TPA fuse 408 has blown from an overcurrent event. The mechanical alarm 418 may include a member 420 displaceable between a first position and a second position. FIG. 4 illustrates the member 420 in a first position 422 where a portion 424 of the member 420 is positioned proximate to a surface of the cartridge 412 indicating the TPA fuse 408 has not blown from an overcurrent event. When the member 420 is in the second position, the portion 424 of the member 420 may extend a distance from the cartridge 412 indicating the TPA fuse 408 has blown from the overcurrent event (discussed in more detail below). While FIG. 4 illustrates the cartridge 412 including a mechanical alarm 418 to indicate when the TPA fuse 408 has blown form an overcurrent event, the cartridge 412 may include an electrical alarm to indicate when the TPA fuse 408 has blown from an overcurrent event. For example, the cartridge 412 may include a light, an LED (light emitting diode), an audible alarm, etc. to indicate when the TPA fuse 408 has blown from an overcurrent event.

The cartridge 412 may have a top portion 426 and a bottom portion 428 opposite the top portion 426. In one example, the cover 404 may be slideably arranged in the top portion 426 of the cartridge 412. The cover 404 may be slideably arranged in the top portion 426 of the cartridge 412 for protecting the TPA fuse 408. While FIG. 4 illustrates the cover 404 may be slideably arranged in the top portion 426 of the cartridge 412, the cover 404 may be slideably arranged in other exterior portions of the cartridge 412. For example, the cover 404 may be slideably arranged in the bottom portion 428 of cartridge 412, a left side surface of the cartridge 412, a right side surface of the cartridge 412, a front side surface of the cartridge 412, a backside surface of the cartridge 412, etc.

Figure 5:
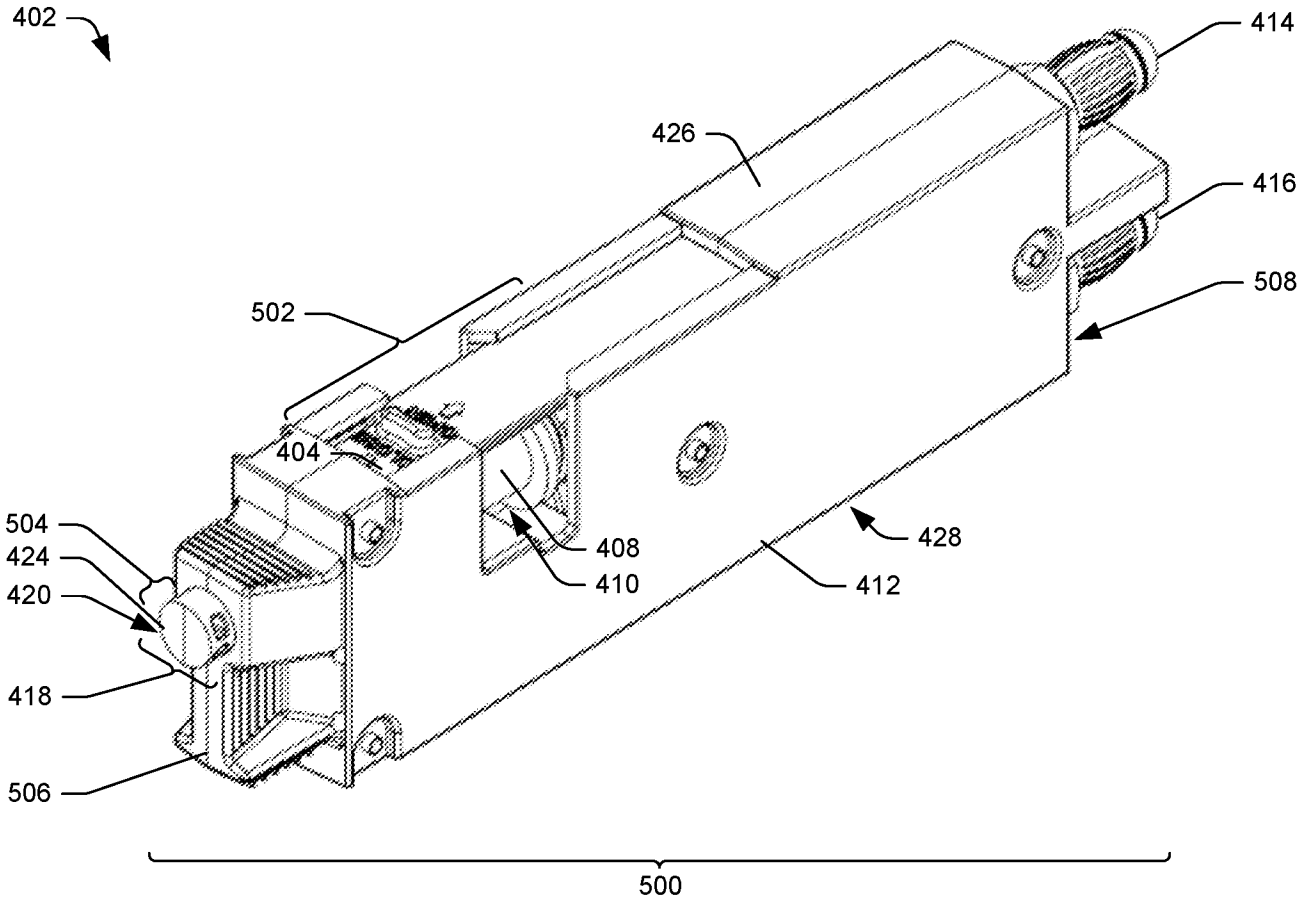
FIG. 5 illustrates a front perspective view of the overcurrent protection device illustrated, in FIG. 4, with the cover in a closed position, the closed cover protecting the TPA fuse removeably received in the receptacle according to an embodiment in this disclosure.

FIG. 5 illustrates a front perspective view 500 of the overcurrent protection device 402 illustrated, in FIG. 4, with the cover 404 in a closed position 502. When the cover 404 is in the closed position 502, the cover 404 may protect the TPA fuse 408. For example, when the cover 404 is in the closed position 502, the cover 404 may protect the TPA fuse 408 form falling debris when the overcurrent protection device 402 is removeably received by the power distribution panel 202. The cover 404 may be displaceable between the open position 406 and the closed position 502. For example, the cover 404 may be slideably displaceable between the open position 406 and the closed position 502. For example, the cover 404 may be linearly displaceably between the open position 406 and the closed position 502. The cover 404 may be arranged with the receptacle 408 such that when the cover 404 is displaced between the open position 406 and the closed position 502, the cover 404 protects the TPA fuse 408 removeably received in the receptacle 410 when the cover 404 is in the closed position 502. While FIG. 5 illustrates the cover 404 may be slideably displaceable between the open position 406 and the closed position 502, the cover 404 may be displaceable between the open position 406 and the closed position 502 in other ways. For example, the cover 404 may be pivoted, rotated, etc. between the open position 406 and the closed position 502.

FIG. 5 illustrates the member 420 in a second position 504 where the portion 424 of the member 420 extends a distance from the cartridge 412 indicating the TPA fuse 408 has blown from an overcurrent event. The cartridge 412 may have a front portion 506 and a back portion 508 opposite the front portion 506. The member 420 may extend the distance from the front portion 506. The power input terminal 414 and the power output terminal 416 may be arranged in the back portion 508.

Figure 6:
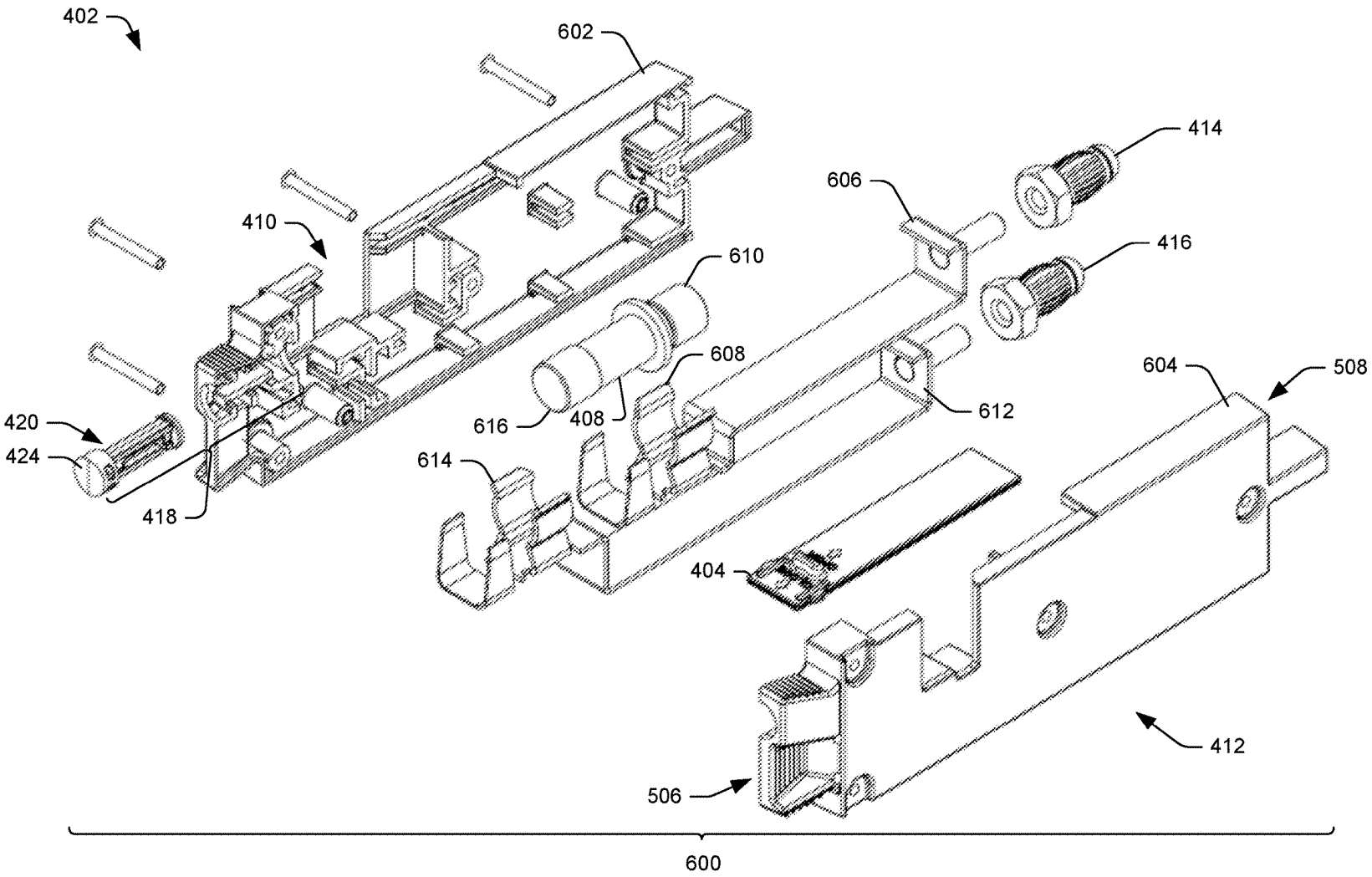
FIG. 6 illustrates an exploded assembly view of the overcurrent protection device illustrated, in FIG. 4, according to an embodiment in this disclosure.

FIG. 6 illustrates an exploded assembly view 600 of the overcurrent protection device 402 illustrated, in FIG. 4, according to an embodiment in this disclosure. The cartridge 412 may include a first member 602 and a second member 604. The first member 602 and the second member 604 may be fastened together via mechanical fasteners, an interference fit, a press fit, a friction fit, a snap fit, an adhesive, etc. The first member 602 may be a first housing and the second member 604 may be a second housing. The first member 602 and the second member 604 may enclose the cartridge 412.

A power input busbar 606 may be arranged in the cartridge 402 from the back portion 508 of the cartridge 402 toward the front portion 506 of the cartridge 402. The power input busbar 606 may have a first fastener 608 arranged in an end of the power input busbar 606 for removeably receiving a portion 610 of the TPA fuse 408. For example, the power input busbar 606 may have a clip arranged in the end of the power input busbar 606 for removeably receiving the portion of the TPA fuse 408.

A power output busbar 612 may be arranged in the cartridge 402 from the back portion 508 of the cartridge 402 toward the front portion 506 of the cartridge 402. The power output busbar 612 may have a second fastener 614 arranged in an end of the power output busbar 612 for removeably receiving another portion 616 of the TPA fuse 408. For example, the power output busbar 612 may have another clip arranged in the end of the power output busbar 612 for removeably receiving the other portion of the TPA fuse 408.

The first fastener 608 electrically connects the TPA fuse 408 to the power input terminal 414 and the second fastener 614 electrically connects the TPA fuse 408 to the power output terminal 416. The TPA fuse 408 may be removeably received into the first fastener 608 and the second fastener 614 via the receptacle 410 to complete the circuit. The power input terminal 414 may be fastened to a stud arranged in the end of the power input busbar 606. The power output terminal 416 may be fastened to a stud arranged in an end of the power output busbar 612.

Figure 7A:
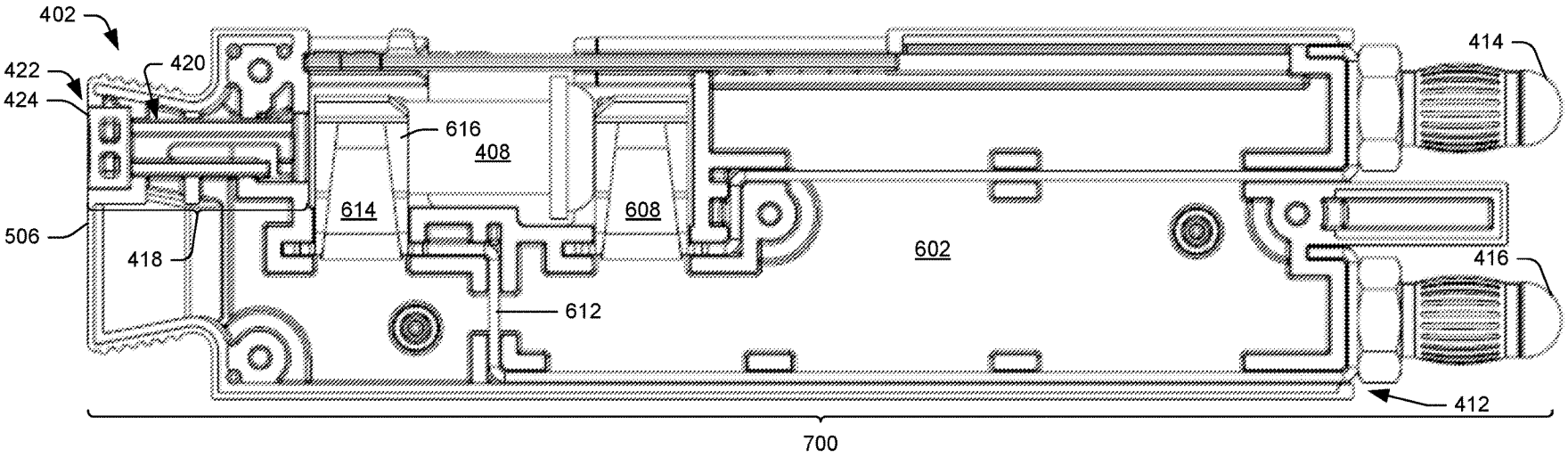
FIG. 7A illustrates a right side view of the overcurrent protection device illustrated, in FIG. 4, with a right side portion of the overcurrent protection device removed and a mechanical alarm in a first position according to an embodiment in this disclosure.

FIG. 7A illustrates a right side view 700 of the overcurrent protection device 402 illustrated, in FIG. 4, with the second member 604 of the cartridge 412 removed (not shown) and the mechanical alarm 418 in the first position 422 according to an embodiment in this disclosure. As discussed above, when the mechanical alarm 418 is in the first position 422, the portion 424 of the member 420 may be positioned proximate to the front portion 506 of the cartridge 412 indicating the TPA fuse 408 has not blown from an overcurrent event.

Figure 7B:
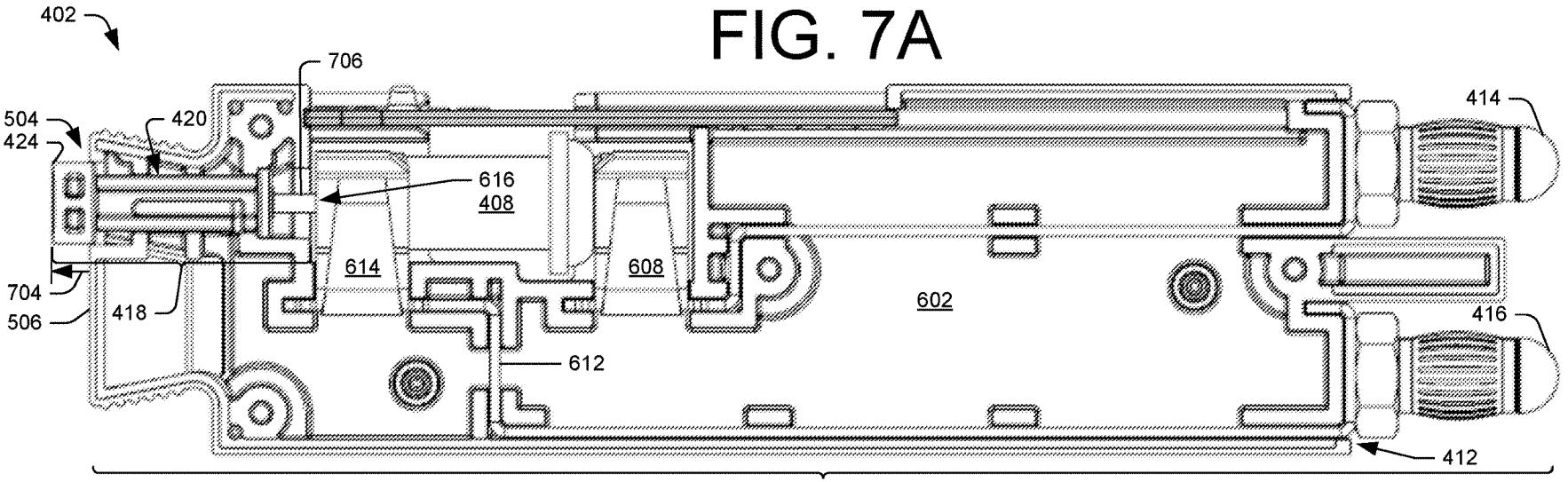
FIG. 7B illustrates a right side view of the overcurrent protection device illustrated, in FIG. 4, with the right side portion of the overcurrent protection device removed and the mechanical alarm in a second position according to an embodiment in this disclosure.

FIG. 7B illustrates a right side view 702 of the overcurrent protection device illustrated, in FIG. 4, with the second member 604 of the cartridge 412 removed (not shown) and the mechanical alarm 418 in the second position 504 according to an embodiment in this disclosure. As discussed above, when the mechanical alarm 418 is in the second position 504, the portion 424 of the member 420 may extend a distance 704 from the front portion 506 of the cartridge 412 indicating the TPA fuse 408 has blown from an overcurrent event.

The TPA fuse 408 may include an indicator pin 706 that extends from the TPA fuse 408 when the TPA fuse 408 has blown from an overcurrent event. The indicator pin 706 may extend from the portion 616 of the TPA fuse 408. For example, the indicator pin 706 may extend from the end of the TPA fuse 408 removeably received in the second fastener 614 of the power output busbar 612. A wire may retain the indicator pin 706 until the TPA fuse 408 experiences an overcurrent event. A spring may be arranged with the indicator pin 706 to force the indicator pin 706 to extend from the TPA fuse 408. When the TPA fuse 408 experiences an overcurrent event, the indicator pin 706 may extend from the end of the TPA fuse 408 and force the member 420 to move from the first position 422 to the second position 504. The TPA fuse 408 may be a 3 A (amperes) rated fuse, 5 A rated fuse, 10 A rated fuse, 15 A rated fuse, 20 A rated fuse, 25 A rated fuse, 30 A rated fuse, 40 A rated fuse, 50 A rated fuse, etc.

Figure 8A:
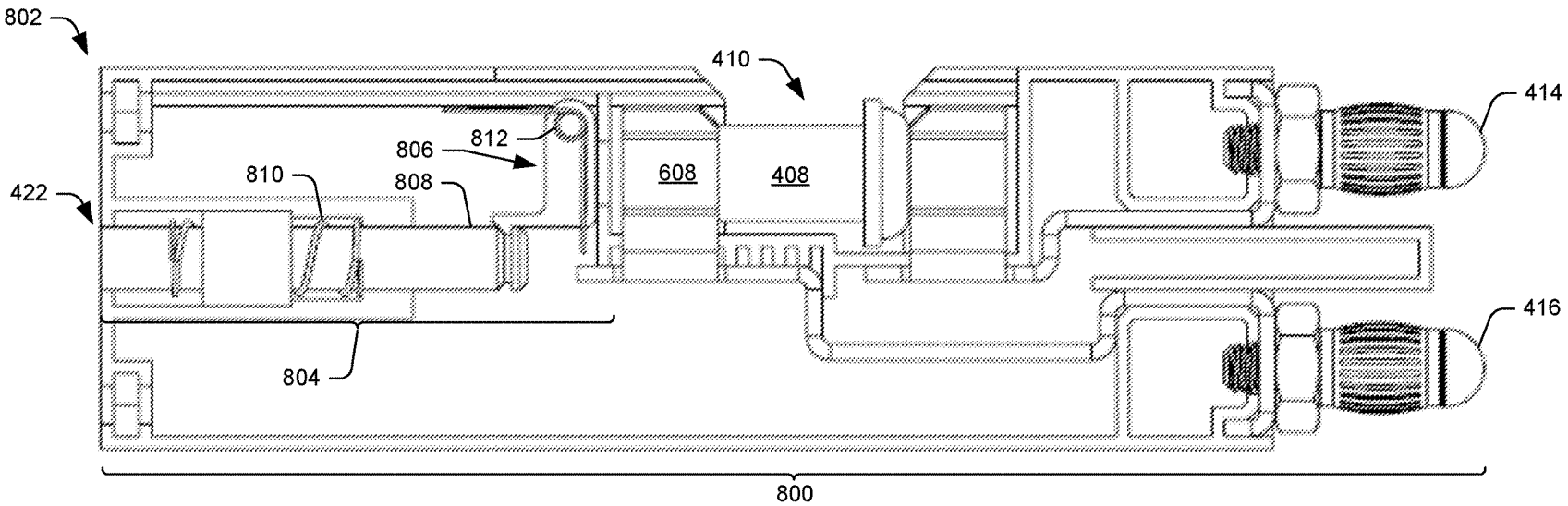
FIG. 8A illustrates a right side view of another overcurrent protection device with a right side portion of the overcurrent protection device removed and a mechanical alarm in a first position according to an embodiment in this disclosure.

FIG. 8A illustrates a right side view 800 of another overcurrent protection device 802, with a second member of a cartridge removed (not shown) and a mechanical alarm 804 in the first position 422 according to an embodiment in this disclosure.

Figure 8B:
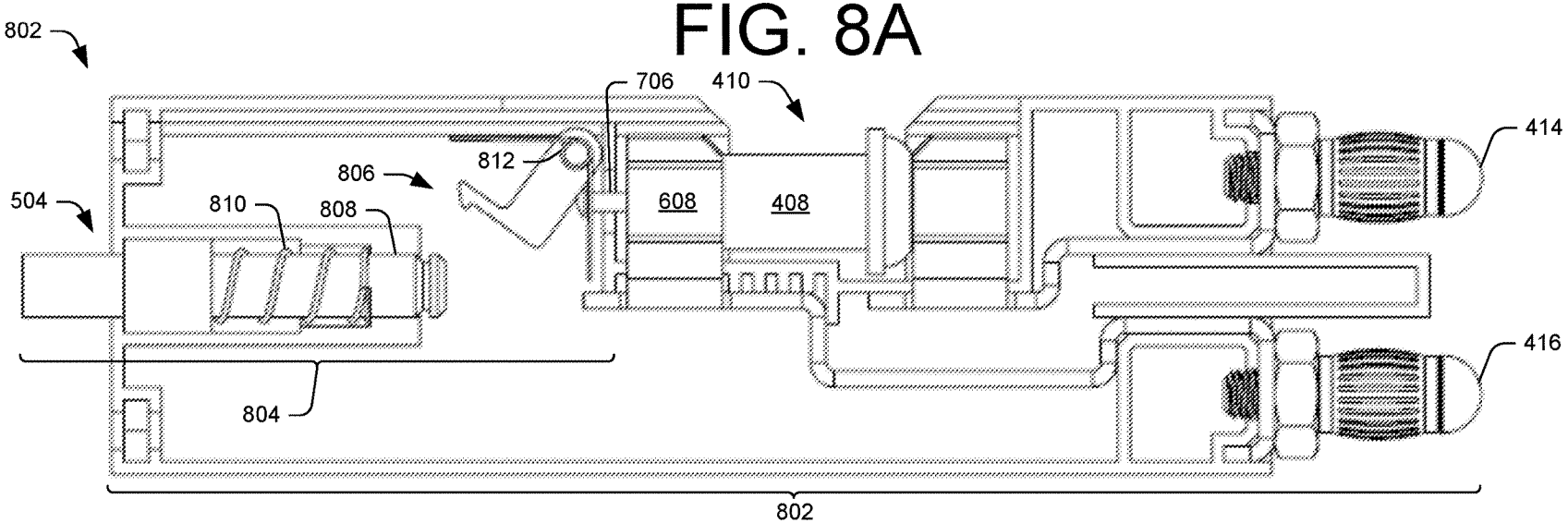
FIG. 8B illustrates a right side view of the overcurrent protection device illustrated, in FIG. 8A, with the right side portion of the other overcurrent protection device removed and the mechanical alarm in a second position according to an embodiment in this disclosure.

FIG. 8B illustrates a right side view of the overcurrent protection device 802 illustrated, in FIG. 8A, with the second member of the cartridge removed (not shown) and the mechanical alarm 804 in the second position 504 according to an embodiment in this disclosure. In this embodiment, the mechanical alarm 804 may include a trigger mechanism 806 arranged proximate to the receptacle 410. The trigger mechanism 806 may provide for releasing a member 808 when the TPA fuse 408 has blown from the overcurrent event. Similar to the member 420 discussed above, the member 808 may displace from the first position 422 to the second position 504 when the TPA fuse 408 has blown from an overcurrent event. The indicator pin 706 of the TPA fuse 408 may force the trigger mechanism 806 to rotate and release the member 808. A compression spring 810 may force the member 808 to displace from the first position 422 to the second position 504. A torsion spring 812 may be arranged with the trigger mechanism 806. The torsion spring 812 may rotate the trigger mechanism 806.

Figure 9:
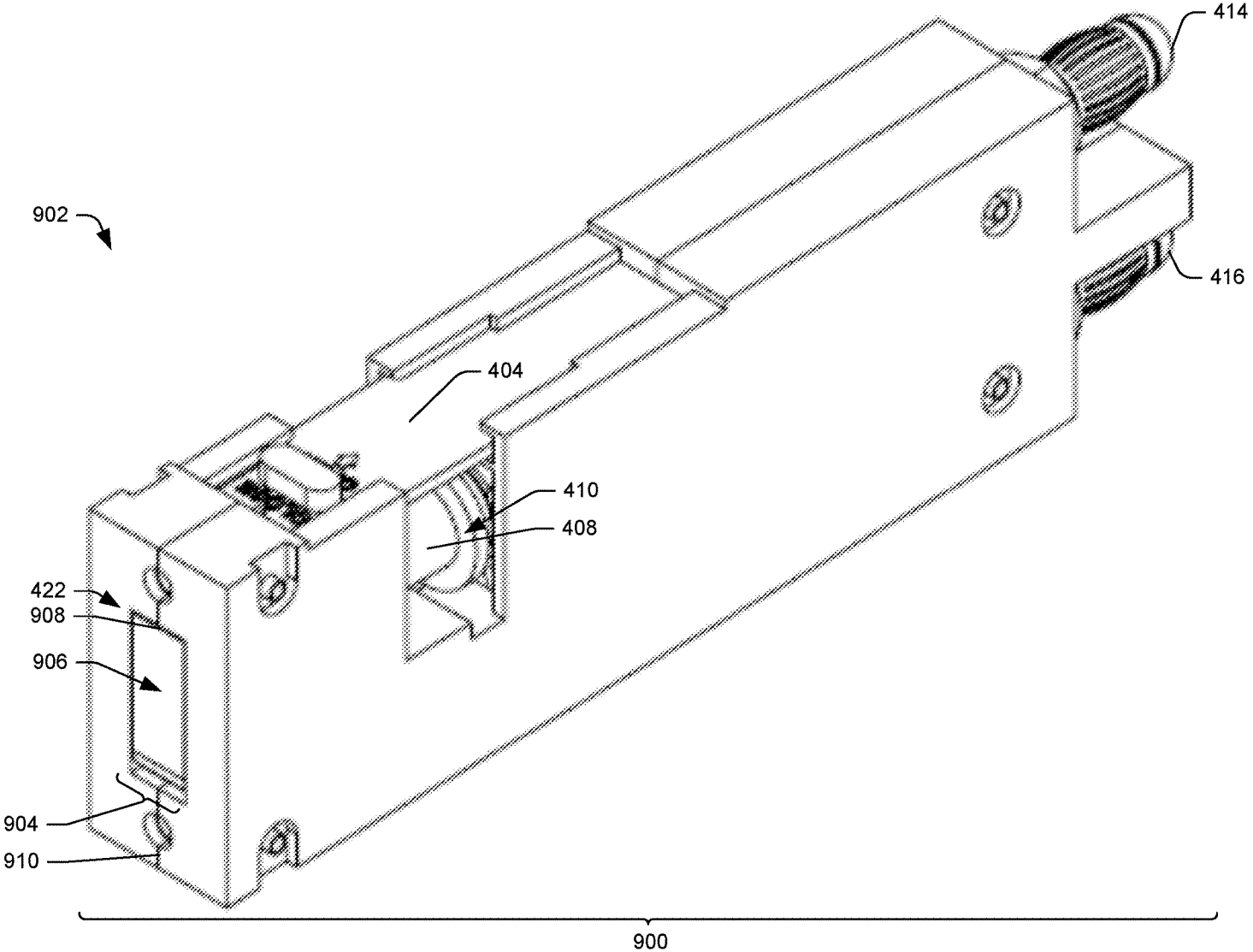
FIG. 9 illustrates a front perspective view of an overcurrent protection device with a mechanical alarm in a first position according to an embodiment in this disclosure.

FIG. 9 illustrates a front perspective view 900 of an overcurrent protection device 902 with a mechanical alarm 904 in the first position 422 according to an embodiment in this disclosure. The mechanical alarm 904 may include a member 906 rotatably displaceable between the first position 422 and the second position 504. For example, the member 906 may be pivotably attached to the cartridge of the overcurrent protection device 902. When the member 906 is in the first position 422 a portion 908 of the member 906 may be positioned proximate to a front portion 910 of the cartridge indicating the TPA fuse 408 has not blown from an overcurrent event. The member 906 may pivot down to the second position 504 indicating the TPA fuse 408 has blown from an overcurrent event (discussed in more detail below).

Figure 10:
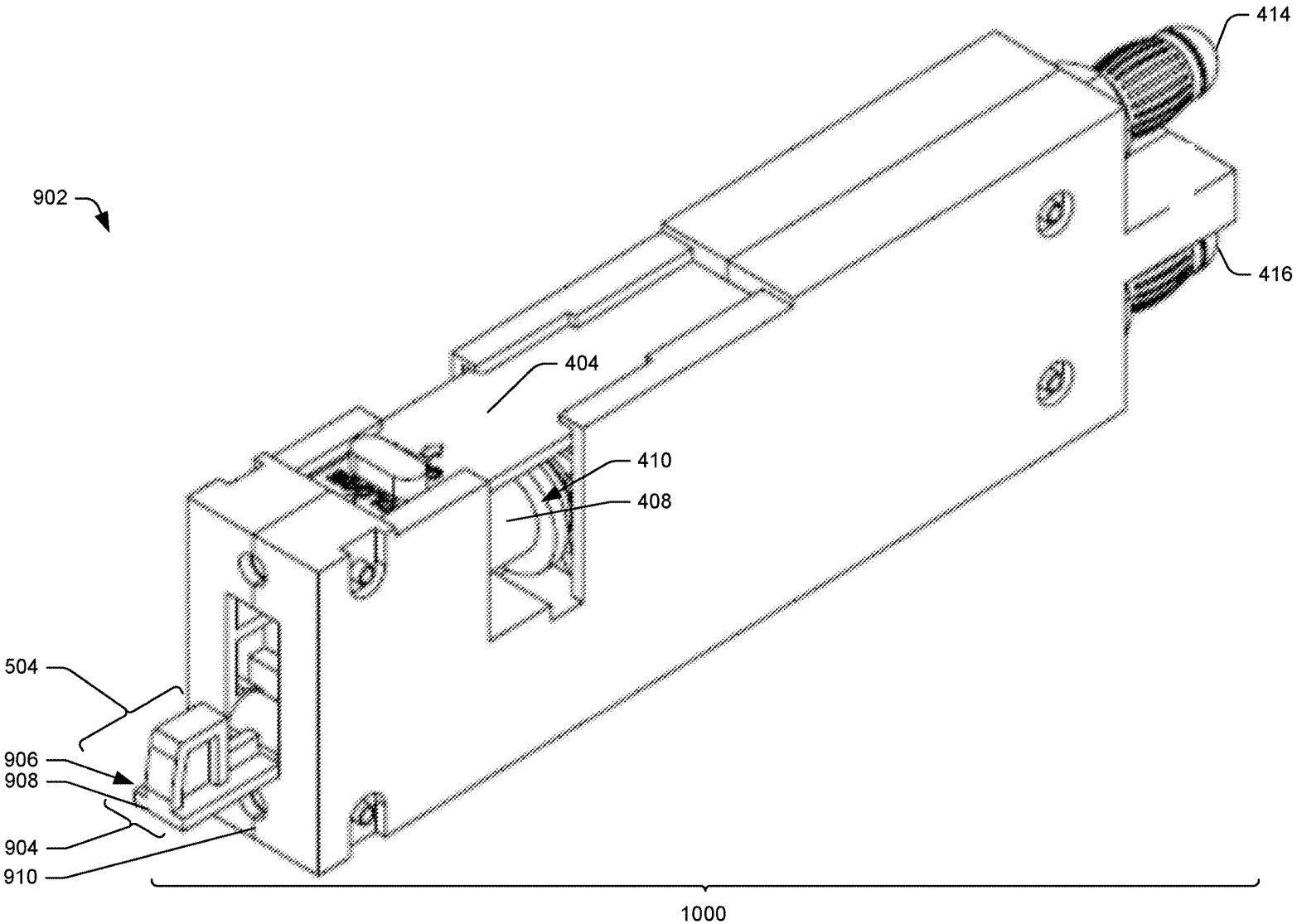
FIG. 10 illustrates a front perspective view of the overcurrent protection device illustrated, in FIG. 9, with the mechanical alarm in a second position according to an embodiment in this disclosure.

FIG. 10 illustrates a front perspective view 1000 of the overcurrent protection device 902 illustrated, in FIG. 9, with the mechanical alarm 904 in the second position 504 according to an embodiment in this disclosure. When the member 906 is in the second position 504 the portion 908 of the member 906 may extend a distance from the front portion 910 of the cartridge of the overcurrent protection device 902 indicating the TPA fuse 408 has blown from an overcurrent event. The member 906 may pivot down from the first position 422 to the second position 504.

Figure 11A:
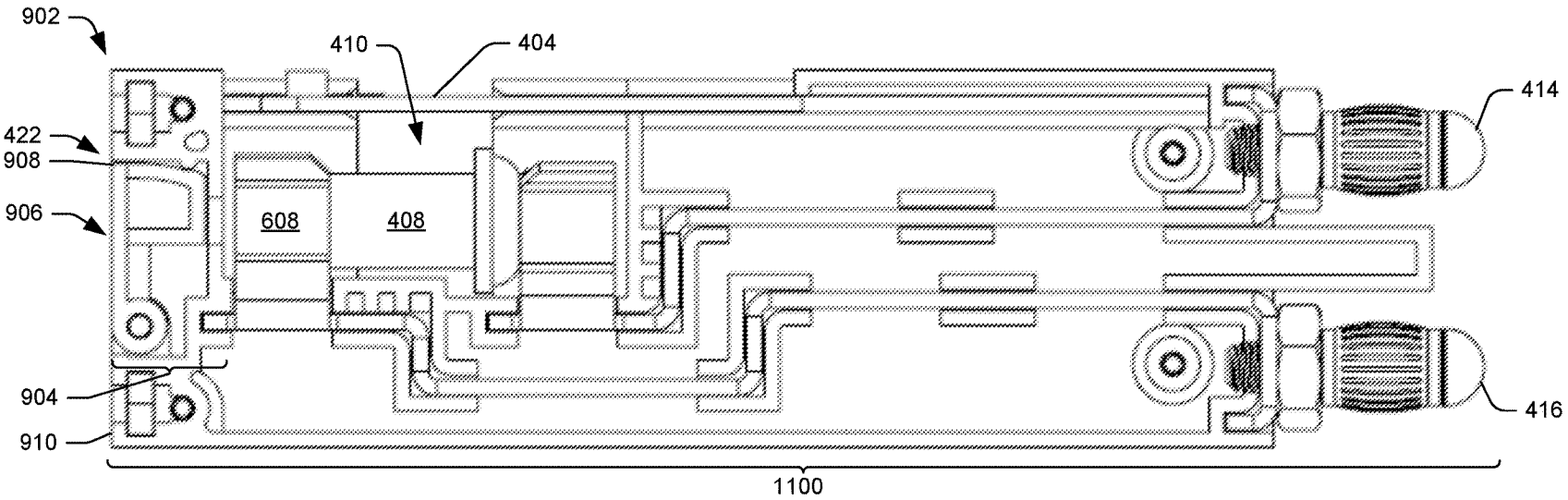
FIG. 11A illustrates a right side view of the overcurrent protection device illustrated, in FIG. 9, with a right side portion of the overcurrent protection device removed and the mechanical alarm in the first position according to an embodiment in this disclosure.

FIG. 11A illustrates a right side view 1100 of the overcurrent protection device 902 illustrated, in FIG. 9, with the second member of the cartridge removed (not shown) and the mechanical alarm 904 in the first position 422 according to an embodiment in this disclosure. As discussed above, when the mechanical alarm 904 is in the first position 422, the portion 908 of the member 906 may be positioned proximate to the front portion 910 of the cartridge indicating the TPA fuse 408 has not blown from an overcurrent event.

Figure 11B:
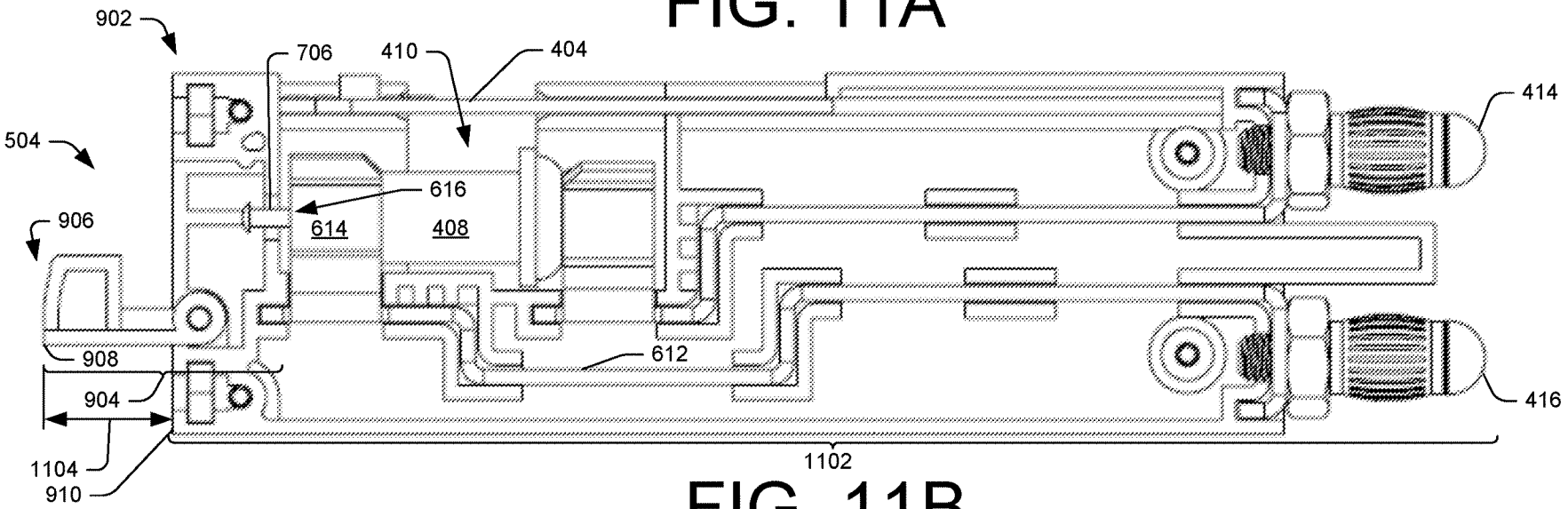
FIG. 11B illustrates the right side view of the overcurrent protection device illustrated, in FIG. 10, with a right side portion of the overcurrent protection device removed and the mechanical alarm in the second position according to an embodiment in this disclosure.

FIG. 11B illustrates a right side view 1102 of the overcurrent protection device 902 illustrated, in FIG. 10, with the second member of the cartridge removed (not shown) and the mechanical alarm 904 in the second position 504 according to an embodiment in this disclosure. As discussed above, when the mechanical alarm 904 is in the second position 504, the portion 908 of the member 906 may extend a distance 1104 from the front portion 910 of the cartridge indicating the TPA fuse 408 has blown from an overcurrent event. The indicator pin 706 of the TPA fuse 408 may extend from the TPA fuse 408 when the TPA fuse 408 has blown from an overcurrent event. The indicator pin 706 may extend from the portion 616 of the TPA fuse 408. For example, the indicator pin 706 may extend from the end of the TPA fuse 408 removeably received in the second fastener 614 of the power output busbar 612. A wire may retain the indicator pin 706 until the TPA fuse 408 experiences an overcurrent event. A spring may be arranged with the indicator pin 706 to force the indicator pin 706 to extend from the TPA fuse 408. When the TPA fuse 408 experiences an overcurrent event, the indicator pin 706 may extend from the end of the TPA fuse 408 and force the member 906 to move from the first position 422 to the second position 504.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative.

What is claimed is:

1. An overcurrent protection device comprising:

a cartridge for removeably receiving a TPA fuse, the cartridge including:

a power input terminal connected to a first end of a power input busbar, the first end of the power input busbar being opposite to a second end of the power input busbar, the second end of the power input busbar directly connectable to a first portion of the TPA fuse, and the power input busbar void of a busbar connection between the first end of the power input busbar and the second end of the power input busbar; and a power output terminal connected to a first end of a power output busbar, the first end of the power output busbar being opposite to a second end of the power output busbar, the second end of the power output busbar directly connectable to a second portion of the TPA fuse, and the power output busbar void of a busbar connection between the first end of the power output busbar and the second end of the power output busbar;

wherein when the cartridge is removeably received by a power distribution panel, the power input terminal directly couples to a power input connection of the power distribution panel, the directly coupled power input terminal void of an intermediate busbar arranged between the cartridge and the power distribution panel, and the power output terminal directly couples to a power output connection of the power distribution panel, the directly coupled power output terminal void of an intermediate busbar arranged between the cartridge and the power distribution panel.

2. The overcurrent protection device of claim 1, wherein the power input terminal includes a bullet type power input terminal and the power output terminal includes a bullet type power output terminal.

3. The overcurrent protection device of claim 1, the cartridge further including a cover arranged in an exterior portion of the cartridge for protecting the TPA fuse, the cover displaceable between an open position and a closed position, wherein when in the closed position the cover protects the TPA fuse.

4. The overcurrent protection device of claim 1, the cartridge having a top portion opposite a bottom portion, and the cartridge further including a cover slideably arranged in the top portion for protecting the TPA fuse, the cover slidable between an open position and a closed position, wherein when in the closed position the cover protects the TPA fuse.

5. The overcurrent protection device of claim 1, the cartridge further including a mechanical alarm to indicate when the TPA fuse has blown from an overcurrent event.

6. The overcurrent protection device of claim 5, wherein the mechanical alarm includes a member displaceable between a first position and a second position, wherein when in the second position a portion of the member extends a distance from the cartridge indicating the TPA fuse has blown from the overcurrent event.

7. An overcurrent protection device comprising:

a cartridge including:

a receptacle for removeably receiving a TPA fuse;

a power input bullet terminal connected to a first end of a power input busbar, the first end of the power input busbar being opposite to a second end of the power input busbar, the second end of the power input busbar disposed in the receptacle and directly connectable to a first portion of the TPA fuse, and the power input busbar void of a busbar connection between the first end of the power input busbar and the second end of the power input busbar;

a power output bullet terminal connected to a first end of a power output busbar, the first end of the power output busbar being opposite to a second end of the power output busbar, the second end of the power output busbar disposed in the receptacle and directly connectable to a second portion of the TPA fuse, and the power output busbar void of a busbar connection between the first end of the power output busbar and the second end of the power output busbar; and wherein when the cartridge in removeably received by a power distribution panel the power input bullet terminal removeably couples with a power input connection of the power distribution panel and the power output bullet terminal removeably couples with a power output connection of the distribution panel.

8. The overcurrent protection device of claim 7, the cartridge further including a cover arranged in an exterior portion of the cartridge for protecting the TPA fuse, the cover displaceable between an open position and a closed position, wherein when in the closed position the cover protects the TPA fuse.

9. The overcurrent protection device of claim 7, the cartridge having a top portion opposite a bottom portion, and the cartridge further including a cover slideably arranged in the top portion for protecting the TPA fuse, the cover slidable between an open position and a closed position, wherein when in the closed position the cover protects the TPA fuse.

10. The overcurrent protection device of claim 7, the cartridge further including a mechanical alarm to indicate when the TPA fuse has blown from an overcurrent event.

11. An overcurrent protection device comprising:

a cartridge having a front portion opposite a back portion and a top portion opposite a bottom portion, the top portion and the bottom portion disposed between the front portion and the back portion, the cartridge including:

a mechanical alarm positioned in the front portion of the cartridge;

a power input terminal positioned in the back portion of the cartridge;

a power output terminal positioned in the back portion of the cartridge;

a receptacle positioned in the top portion of the cartridge between the mechanical alarm positioned in the front portion of the cartridge and the power input terminal and power output terminal positioned in the back portion of the cartridge for removeably receiving a TPA fuse; and a cover positioned in the top portion of the cartridge with the receptacle, the cover slideably positioned in one or more channels positioned in the cartridge and displaceable between an open position and a closed position, wherein when in the closed position the cover protects the TPA fuse removeably received in the receptacle.

12. The overcurrent protection device of claim 11, wherein the mechanical alarm indicates when the TPA fuse has blown from an overcurrent event.

13. The overcurrent protection device of claim 11, wherein when the cartridge is removeably received by a power distribution panel, the power input terminal and the power output terminal directly couple to a power input connection of the power distribution panel, the directly coupled power input terminal and power output terminal void of an intermediate busbar arranged between the cartridge and the power distribution panel.

14. An overcurrent protection device comprising:

a cartridge including:

a receptacle for removeably receiving a TPA fuse, the TPA fuse including an indicator pin, and a mechanical alarm to indicate when the TPA fuse has blown from an overcurrent event, the mechanical alarm including a member displaceable between a first position and a second position, wherein the indicator pin forces the member to displace from the first position to the second position, and when in the second position a portion of the member extends a distance from the cartridge indicating the TPA fuse has blown from the overcurrent event.

15. The overcurrent protection device of claim 14, the cartridge having a front portion opposite a back portion, and wherein the member extends the distance from the front portion.

16. The overcurrent protection device of claim 14, the cartridge having a front portion opposite a back portion, and the cartridge further including a power input terminal and a power output terminal arranged in the back portion.

17. The overcurrent protection device of claim 16, wherein the power input terminal includes a bullet type power input terminal and the power output terminal includes a bullet type power output terminal.

18. The overcurrent protection device of claim 16, wherein when the cartridge is removeably received by a power distribution panel, the power input terminal and the power output terminal directly couple to a power input connection of the power distribution panel, the directly coupled power input terminal and power output terminal void of an intermediate busbar arranged between the cartridge and the power distribution panel.

* * * * *